US005339736A

United States Patent [19]

Dörsam et al.

[11] Patent Number: 5,339,736

[45] Date of Patent: Aug. 23, 1994

[54] ROLLER BEARING SUPPORT ASSEMBLY

[75] Inventors: Willi R. L. Dörsam, Höchberg; Christian M. M. Fischer, Marktheidenfeld, both of Fed. Rep. of Germany

[73] Assignee: Koenig & Bauer Aktiengesellschaft, Wurzburg, Fed. Rep. of Germany

[21] Appl. No.: 985,311

[22] Filed: Dec. 4, 1992

[30] Foreign Application Priority Data

Dec. 6, 1991 [DE] Fed. Rep. of Germany ..... 4140219

[51] Int. Cl.[5] ..... B41F 31/32; B41L 27/34

[52] U.S. Cl. ..... 101/352

[58] Field of Search ..... 101/348, 349, 351, 352, 101/207–210, 147, 148

[56] References Cited

U.S. PATENT DOCUMENTS

| | | | |
|---|---|---|---|
| 552,790 | 1/1896 | Splithoff . | |
| 1,377,142 | 5/1921 | Saborsky . | |
| 2,607,291 | 8/1952 | Jacobson . | |
| 2,751,843 | 6/1956 | Faeber | 101/352 X |
| 2,763,207 | 9/1956 | McWhorter | 101/348 |
| 3,603,254 | 9/1971 | Siebke | 101/352 |
| 3,691,956 | 9/1972 | James et al. | 101/247 |
| 3,934,508 | 1/1976 | Heimlicher | 101/349 |

FOREIGN PATENT DOCUMENTS

| | | |
|---|---|---|
| 1291751 | 8/1967 | Fed. Rep. of Germany . |
| 2413459 | 3/1974 | Fed. Rep. of Germany . |
| 3825517 | 7/1988 | Fed. Rep. of Germany . |
| 237454 | 9/1924 | United Kingdom . |

*Primary Examiner*—J. Reed Fisher
*Attorney, Agent, or Firm*—Jones, Tullar & Cooper

[57] ABSTRACT

A roller bearing support assembly utilizes one or more pairs of lever arms to support an ink forme roller or a dampening forme roller. Each lever arm includes a U-shaped seat for an axle trunnion of the roller. These seats facilitate the quick removal and replacement of the rollers in the levers without disruption of the roller's adjustment. The rollers can be thrown on or thrown off the cooperating plate cylinder by pivotal movement of the lever arms.

19 Claims, 2 Drawing Sheets

ROLLER BEARING SUPPORT ASSEMBLY

FIELD OF THE INVENTION

The present invention is directed generally to a roller bearing support assembly. More particularly, the present invention is directed to a bearing support assembly for axle trunnions of an exchangeable roller. Most specifically, the present invention is directed to a bearing support assembly for axle trunnions of exchangeable rollers in a rotary printing press. The exchangeable rollers, which are typically ink or dampening forme rollers in rotary presses, cooperate with an oscillating roller and a plate cylinder and are moved into and out of contact with these cooperating rollers and cylinders. The bearing support assembly utilizes one or more pairs of lever arms which are pivotably secured at first ends and which support the cylinder bearings in second ends. The axle trunnions of the cylinders can be adjustably positioned in the lever arms.

DESCRIPTION OF THE PRIOR ART

In various rotary printing press assemblies it is often necessary to be able to dismount and remove the ink forme rollers and the dampening forme rollers so that these rollers can be cleaned. Since the removal and reinstallation of these rollers must be done relatively frequently, it is important that this task not require a great deal of time. While the dismounting and replacement of these rollers should be accomplished quickly, it is also important that a large amount of adjusting of the position of the rollers should not be required when the rollers are again mounted in the rotary printing press. These two requirements of ease of removal and remounting without the need for substantial position adjusting have not been easily accomplished in prior art devices.

In one prior art device which is shown in German patent specification No. 12 91 751 there is shown a roller lock for bearings of dampening or ink rollers in offset presses. In this device there is provided a bar which is executed as a semi-circular, spring-loaded segment, with this bar being arranged swivelling in a recess of the bearing support. This bar has a circular surface at its section which locks the bearing of the roller. This circular surface has a center of curvature which is outside of the swivelling axis of the segment.

A limitation of this prior art roller support is that there is actuated an additional shaft around which the spring-loaded locking segment is arranged for swivelling or pivotal motion for the purpose of locking the bearing of the roller. This rather costly bearing locking device cannot be used with web-fed rotary printing presses that have impression throw-on and throw-off simply because of the limited space that is available in presses of this type.

Another prior art support for intermediate rollers of an inking unit is shown in German patent specification No. 24 13 459. In this device, the thrust bearing for the roller is tilted by means of a handle so that the roller is freed and can be removed. However, this prior art device is usable only with stationary intermediate rollers and cannot be used with rollers of an inking or dampening unit that are intended to be thrown on and thrown off the roller or rollers with which they cooperate.

It will thus be seen that a need exists for a cylinder or roller bearing support assembly that overcomes the limitations of the prior art. The bearing support assembly of the present invention provides such a device and is a substantial improvement over the prior art devices.

SUMMARY OF THE INVENTION

It is an object of the present invention to provide a roller bearing support assembly.

Another object of the present invention is to provide a bearing support assembly for axle trunnions of exchangeable rollers.

A further object of the present invention is to provide a bearing support assembly for axle trunnions of exchangeable rollers in a rotary printing press.

Yet another object of the present invention is to provide a bearing support assembly for rollers which are thrown-on and thrown-off cylinders in a rotary printing press.

Still a further object of the present invention is to provide a bearing support assembly which is uncomplicated and which functions in a reliable manner.

Even yet another object of the present invention is to provide a bearing support assembly for exchangeable rollers in a rotary printing press.

As will be discussed in detail in the description of the preferred embodiments which are set forth subsequently, the roller bearing support assembly in accordance with the present invention utilizes a pair of spaced lever arms to support the axle trunnions of an ink forme roller or a dampening fluid roller. Each lever arm is generally arcuate in shape and is pivotably connected to the frame of the rotary printing press at a first end. A second end of each lever arm has a somewhat U or channel shaped recess into which the axle trunnion is placed. Spaced guide faces engage the axle trunnion on two opposing sides, while adjustable threaded screws are used to engage the axle trunnion on two other opposing sides. The axle trunnion is thus supported on four sides. One of the threaded screws is supported by a cross piece which extends across the mouth of the U or channel shaped portion and which is readily removable.

Each of the one or two pairs of arms is connected to a hydraulic or pneumatic cylinder which is usable to move its associated lever arm so that the roller supported between the pair of lever arms can be thrown on or thrown off a cylinder or cylinders with which it cooperates. A generally circular aperture in each lever arm is positioned generally concentrically about a locating member that extends from the press frame. A threaded screw extends through the lever arm and into the circular aperture. This screw abuts the locating member when the lever arm is properly positioned.

The roller bearing support assembly of the present invention provides several beneficial results. The axle trunnions of the ink and dampening rollers are securely positioned in the generally U or channel shaped recess in the free end of each lever arm and are supported at four spaced points. This support is quite solid and secure yet still allows the rollers to be thrown on and thrown off their cooperating cylinder or cylinders while having essentially no play yet facilitating a fast and uncomplicated exchange of rollers. By removal of the cross-piece which covers the U or channel shaped recess and by leaving the adjustable screw support which is carried by the cross piece unchanged, the axle trunnion can be removed from between the lever arms and can then be re-installed without having its adjusted position unchanged. The cross-piece is easily removed by unscrewing only two screws.

The roller bearing support assembly of the present invention is simple in construction, is uncomplicated in manufacture, and utilized standard parts. Thus it provides a bearing support arrangement which overcomes the limitations of the prior art devices and which is a substantial advance in the art.

BRIEF DESCRIPTION OF THE DRAWINGS

While the novel features of the roller bearing support assembly in accordance with the present invention are set forth with particularity in the appended claims, a full and complete understanding of the invention may be had by referring to the detailed description of the preferred embodiments which are presented subsequently, and as illustrated in the accompanying drawings, in which:

DESCRIPTION OF THE PREFERRED EMBODIMENTS

Figure 1:
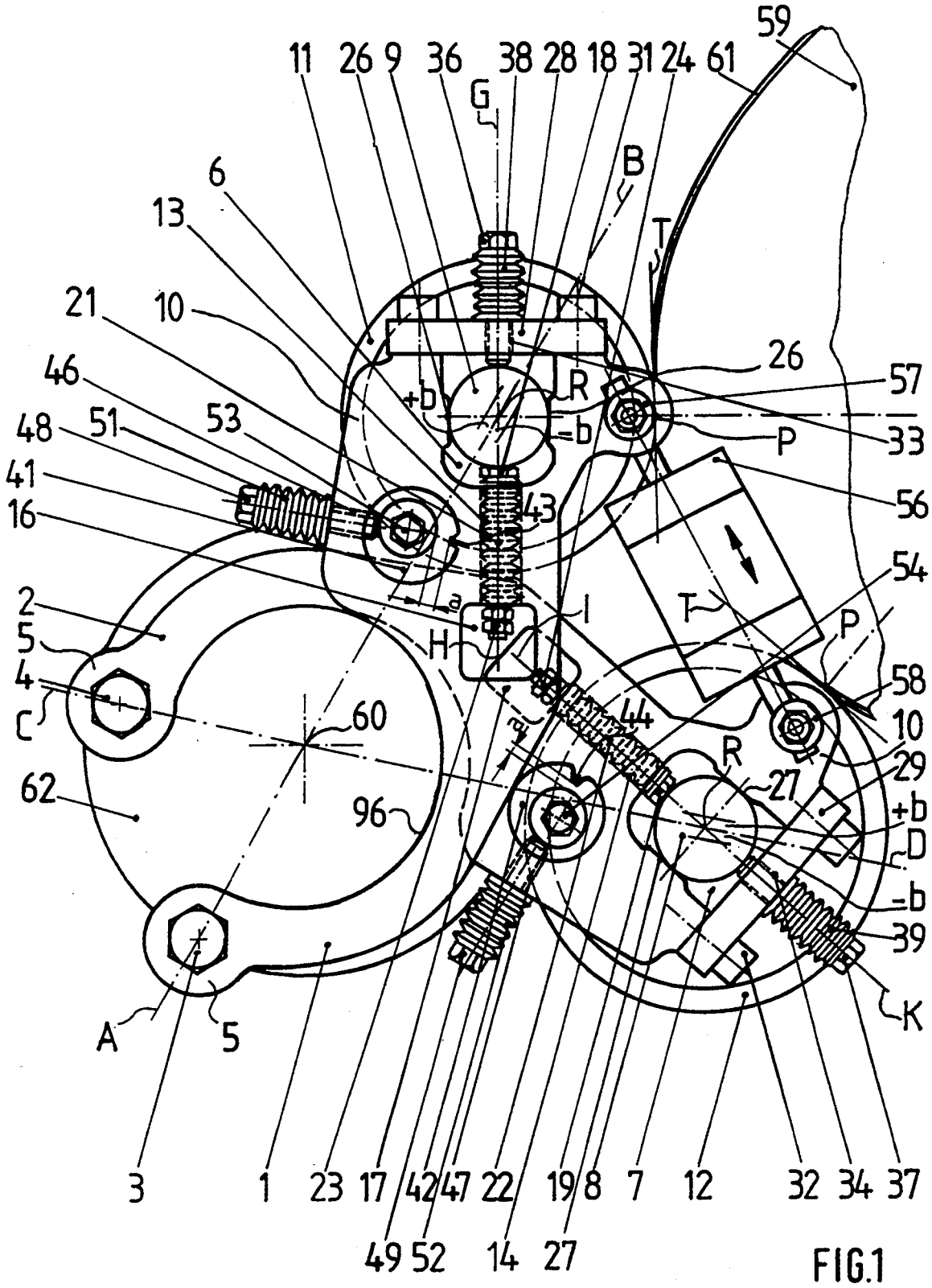
FIG. 1 is a side elevation view of a first preferred embodiment of the roller bearing support assembly of the present invention and showing an arrangement with two rollers thrown on to a plate cylinder.
Figure 2:
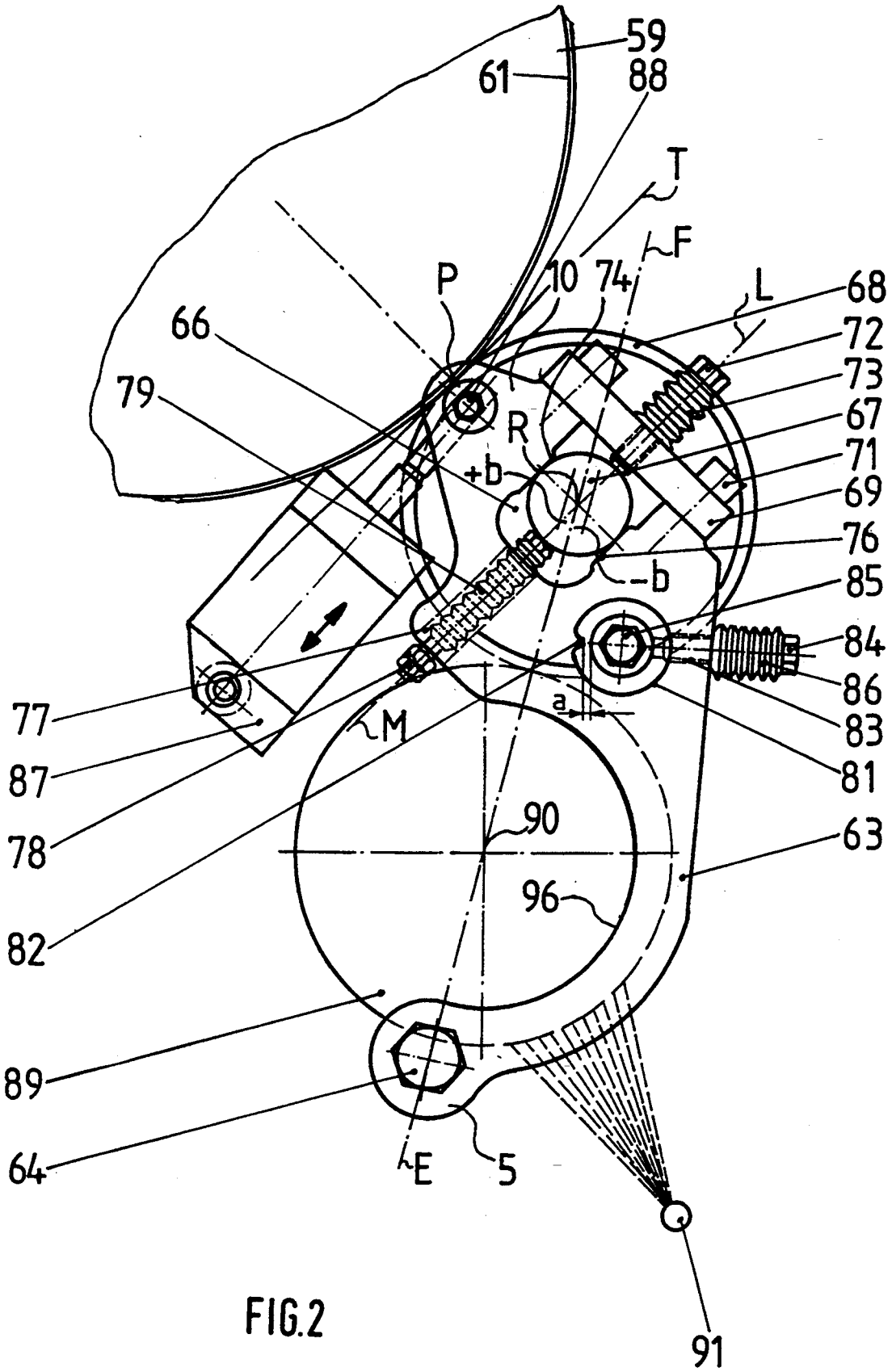
FIG. 2 is a side elevation view of a second preferred embodiment of the present invention and showing a bearing support assembly with a dampening forme roller thrown on a plate cylinder.

Referring initially to FIG. 1, there may be seen a first preferred embodiment of a roller bearing support assembly in accordance with the present invention. In this first preferred embodiment, a pair of ink forme rollers, generally at 11 and 12 are supported by first and second lever arms 1 and 2 and are capable of being thrown on and thrown off or moved into and out of contact with a plate cylinder 59 that carries one or more printing plates 61 on its surface. The ink forme rollers 11 and 12 are also supported by the lever arms 1 and 2 in contact with an oscillating roller 62. It will be understood during the discussion of this first preferred embodiment as depicted in FIG. 1 and during the discussion of the second preferred embodiment which is shown in FIG. 2 that each lever arm 1, 2 or 63 of FIG. 2, supports a first end of its roller 11, 12 or 68, respectively and that a generally identical lever, which is not specifically shown in the drawing, supports a second end of each roller. Thus while lever arms 1, 2 and 63 will be discussed as individual levers, each is actually one lever of a lever arm pair which cooperatively support one of the rollers 11, 12 or 68.

Referring again initially to FIG. 1 each lever arm 1 and 2 is rotatably or pivotably supported at a first end 5 in the side wall of a machine frame, which is not specifically shown in the drawings, by means of a borehole in first end 5 and by means of a cylindrically body such as, for example a hexagon cap screw with a supported shaft, generally indicated at 3 and 4 on lever arms 1 and 2, respectively. A second end 10 of each of the generally arcuately shaped lever arms 1 and 2 is provided with a generally U or channel shaped seat 6 or 7, respectively. These seats 6 and 7 receive and support an axle trunnion 8 or 9 of one of the ink forme rollers 11 or 12. Each of the U-shaped seats 6 and 7 has a conical or tapering bottom borehole 13 or 14 which extends from the inner bottom portion of the seat in a direction generally along the longitudinal axis of its corresponding lever arm 1 or 2. Each of these bottom boreholes 13 and 14 terminates at a generally square-shaped opening 16 or 17 in the corresponding lever 1 or 2. These conical bottom boreholes 13 and 14 secure elongated threaded screws 18 and 19 which have upper or outer ends that resiliently engage and support the axle trunnions 8 and 9 and which have inner ends that extend into the square openings 16 and 17. Double adjusting nuts 23 and 24 are positioned on the inner ends of these bottom elongated screws 18 and 19. A plurality of cup spring packets, which may be Belleville washers or the like, are placed on each of the threaded screws 18 and 19.

As may be seen in FIG. 1, each of the generally U-shaped seats 6 and 7 has its side walls formed as spaced, generally parallel cheeks or guide surfaces 26 and 27 for the axle trunnion 8 or 9 of the corresponding ink forme roller 11 or 12 which is supported by each lever arm pair 1 or 2. The open mouth portion of each of the U-shaped seats is closed by a removable cross piece 28 or 29. Each cross piece 28 or 29 is secured to the second end 10 of its lever arm 1 or 2 by spaced screws 31 and 32 which pass through the cross pieces 28 or 29 and which are received in threaded bores, not specifically shown, in the ends of the legs of the U-shaped seats 6 and 7. Each cross piece 28 or 29 is provided with a threaded bore 33 or 34 generally at its middle with this bore or taphole 33 or 34 being generally parallel to the side cheeks 26 and 27 of the U-shaped pocket 6 or 7. A threaded screw 36 or 37 is received in this threaded borehole 33 or 34. Each such threaded screw 36 or 37 carries a cup spring packet 38 or 39. It will thus be seen that each axle trunnion 8 or 9 is securely yet adjustably supported in its U-shaped pocket or seat 6 or 7 in the second end 10 of its respective lever arm 1 or 2. The bottom threaded screws 18 and 19, in conjunction with the upper threaded screws 36 and 37 serve to adjust the position of the axle trunnions 8 and 9 longitudinally in the U-shaped seats 6 and 7. The cheeks or guide surfaces 26 or 27 allow the axle trunnions 8 or 9 to slide longitudinally in the absence of the bottom screws 18 and 19 and the upper screws 36 and 37, but prevent lateral movement. Once the bottom screws 18 and 19 and the upper screws 36 and 37 have been adjusted, with the adjusted positions being held securely by the cup spring packets 21 and 22 or 38 and 39, respectively, the positions of the axle trunnions 8 and 9 in their U-shaped pockets 6 and 7 are fixed. However, when it is necessary to remove one of the ink forme rollers 11 or 12 from its pair of spaced lever arms 1 or 2 for cleaning or other servicing, this can be quickly and easily accomplished by removal of the upper cross pieces 28 or 29. This is accomplished by loosening and removing the cross piece securement screws 31 or 32. Such removal of the cross pieces 28 or 29 does not alter the position of the upper adjusting screws 36 or 37 which are carried by the cross pieces 28 and 29. Thus the ink forme rollers 11 and 12 can be removed, cleaned, and reinstalled quickly and without the need to accomplish further adjustment.

Referring again to the first preferred embodiment of the roller bearing support assembly of the present invention, as shown in FIG. 1, each lever arms 1 and 2 has a generally circular opening 41 or 42 respectively with this circular opening 41 or 42 being positioned generally laterally adjacent the borehole 13 or 14 for the bottom adjusting screw 18 or 19. Each of these openings 41 or 42 is generally circular but has a radially inwardly directed nose or projection 43 or 44 whose usage will be discussed in detail shortly. A threaded tap hole 46 or 47 extends from an outer side surface of each lever arm 1 or 2 inwardly and terminates in the generally circular opening 41 or 42 approximately diametrically opposite to the nose or projection 43 or 44. The axis of this tap hole 46 or 47 is generally parallel to a longitudinal axis of the cross piece 28 or 29. Each of these threaded tap holes 46 and 47 receives a threaded screw 48 or 49 with the shank of the screw exterior to the side of the lever arm 1 or 2 carrying a cup spring packet 51 or 52 to tension the threaded screw 48 or 49. An inner end of each threaded side adjusting screw 48 or 49 terminates in the generally circular opening 41 or 42.

An abutment screw 53 or 54 is secured in the side wall of the machine frame which is not specifically shown in the drawing. This abutment screw 53 or 54 is aligned generally with the center of the circular opening 41 or 42 in its respective lever arm 1 or 2 and acts as a fixed stop for the inner end of the side adjusting screws 48 and 49. Pivotal movement of the lever arms 1 and 2 toward the plate cylinder 59 is, to some extent, limited by the engagement of the inner end of the side adjustment screws 48 and 49 with the abutment screws 53 and 54.

An inner portion of the second end 10 of each of the pivotable lever arms 1 and 2 is secured to an end of a piston rod of a single acting cylinder 56, as may be seen in FIG. 1. Suitable fastening devices 57 and 58 which may be hexagon headed cap screws with fitting shafts are used to connect the piston rods to the lever arms 1 and 2. As the cylinder 56 is actuated, the piston rods move and cause the lever arms 1 and 2 to pivot about their first ends 5 which are secured to the machine frame by the screws 3 and 4, as was discussed previously. This pivotal motion of the lever arms 1 and 2 causes the ink forme rollers 11 and 12 carried thereby to be thrown on or thrown off the plate cylinder 59 and its printing plate or plates 61.

The amount of play "a" or the distance of travel of each ink forme roller 11 or 12 between its thrown on and thrown off positions is determined by the spacing between the nose or projection 43 or 44 in each circular opening 41 or 42 and the abutment screw 53 or 59 which extends into that opening. Backing off the side adjusting screws 48 and 49 can increase the distance "a" or can increase the pressure that the ink forme rollers exert on the printing plate or plates 61. The impression pressure of the ink forme rollers 11 and 12 against the plate cylinder 59 and against the oscillating roller 62 whose center of rotation is indicated at 60 can also be adjusted by use of the upper threaded screws 36 and 37 which are carried by the cross pieces 28 and 29. As was discussed previously, the cup spring packets 38 and 39, or 51 and 52 act as a locking means for their threaded screws 36 and 37 or 48 and 49. The cup spring packets 21 and 22 act as a counterforce to the threaded screws 36 and 37. It will again be recalled that each of the lever arms 1 and 2 shown in FIG. 1 has a second cooperating lever arm secured to a second side wall of the machine frame.

Turning now to FIG. 2 of the drawings there may be seen a second preferred embodiment of a roller bearing support assembly in accordance with the present invention. In this second preferred embodiment, a single lever arm 63 is shown for supporting a dampening forme roller 68 which can be thrown on and off a plate cylinder 59 and a distributor roller 89 which has an axis of rotation 90. This lever 63 is pivotably or rotatably supported at its first end 5 by a securement screw and a cylindrical body 64 generally in the manner as discussed with the first preferred embodiment. A second end 10 of the lever 63 is provided with a generally U-shaped or channel-shaped seat 66 which will receive an axle trunnion 67 of the dampening forme roller 68. The generally U-shaped seat 66 has its open mouth closed by a cross-piece 69 that is secured in place by two securement screws 71. As was the case with the first embodiment, in this second preferred embodiment depicted in FIG. 2, the cross piece 69 has a tapped hole that receives an upper threaded adjusting screw 72 which is provided with a cup spring packet 73. The side walls of the U-shaped pocket 66 are utilized as side cheeks or guide surfaces 74 and 76 which prevent the axle trunnion 67 from moving laterally in the U-shaped seat 66. A conical borehole 77 extends from the bottom of the seat or pocket 66 with its longitudinal axis generally parallel to the side cheeks 74 and 76. This borehole 77 receives a threaded bottom adjusting screw 78 that carries a cup spring packet 79 and that resiliently supports the bottom of the axle trunnion 67.

A generally circular opening 81 is formed in the lever 63 intermediate its ends and generally adjacent the borehole 77. This opening 81 has a radially inwardly directed nose or projection 82. Diametrically opposite nose 82 a threaded tap hole 83 extends to the longitudinal outer edge of the lever arm 63. A threaded side adjusting screw 84, which is provided with a cup spring packet 86, is positioned in the tap hole 83. An abutment screw 85 is secured to the machine side frame and extends into the generally circular opening 81 in the lever 63. This abutment screw 85 may have an enlarged, generally cylindrical surface in a manner the same as abutment screws 53 and 54 which will be engaged by the nose 82 or the inner end of the side adjustment screw 84 to define the travel distance "a" of the lever 63 as it pivots about its first end 5 on the cylindrical body 64 which acts as a pivot point for the lever 63.

A single acting cylinder 82 has a piston rod which is connected to an inner portion of the second end 10 of the lever 63 by a suitable fastening means, generally at 88. This cylinder is used to accomplish the throw-on or throw-off of the dampening forme roller 68 with respect to the plate cylinder 59. The play or distance "a" for the throw-on motion of the dampening forme roller 68 is adjusted by rotation of the side adjustment screw 84 against the abutment screw 85. The pressure exerted by the dampening forme roller 68 against the oscillating distributor roller 89 is adjusted by means of the upper adjustment screw 72. A source of dampening fluid is schematically depicted at 91 in FIG. 2.

The cup spring packets 79 and 86 impart a force against their cooperating threaded screws 72 and 84 so that these screws will remain in an adjusted position. As was the case with the first preferred embodiment discussed with reference to FIG. 1, the second preferred embodiment of the roller bearing support assembly shown in FIG. 2 will be understood as utilizing two levers 63 to support the two ends of the dampening forme roller 68. While only one such lever 63 is shown, it will be understood that a second lever is utilized.

Referring now to both FIGS. 1 and 2, it will be seen that each of the levers 1, 2 and 63 has a somewhat arcuate or curved portion which is indicated at 96. This curved portion intermediate the first and second ends 5 and 10, respectively of each lever provides access to the supports for the rollers 62 and 89. Thus these rollers can be accessed for adjustment and repair.

The longitudinal axis of the screw or cylindrical body 3, 4 or 64 about which the levers 1, 2, or 63 rotate, and the axis of rotation 60 or 90 of the oscillating roller 62 or 89 lie on a plane A-B, C-D, or E-F, respectively, as may be seen in FIGS. 1 and 2. The ink forme rollers 11 and 12, or the dampening forme roller 68 have centers of rotation R which are located at a distance "b" of ±2 mm from the associated plane or line A-B, C-D, or E-F, respectively. In addition, these centers of rotation R of the ink or dampening forme rollers 11, 12 and 68 are positioned along the longitudinal axes of the upper and lower adjusting screws. The longitudinal axes or line of influence of screws 18 and 36 for roller 11 is indicated as G-H. The line of influence of screws 19 and 37 for roller 12 is indicated as I-K. The line of influence of screws 72 and 78 for roller 68 is designated as L-M.

The guiding surfaces or cheeks 26 and 27 of the U-shaped seats or pockets 6 and 7 of the lever arms 1 and 2; and the guiding surfaces or cheeks 74 and 76 of the U-shaped seat or pocket 66 of the lever arm 63 are essentially parallel to a line T which is the tangent of the point of contact P of the ink or dampening forme rollers 11, 12 or 68 with the plate cylinder 59. If the diameter of the plate cylinder 59 is changed, or if the ink or dampening forme cylinders change in diameter due to wearing effects or the like, this condition can change or vary.

While first and second preferred embodiments of a roller bearing support assembly in accordance with the present invention have been set forth fully and completely hereinabove, it will be apparent to one of skill in the art that a number of changes in, for example the type of axle bearings used, the overall sizes of the various rollers and cylinders, the drives for the cylinders, and the like can be made without departing from the true spirit and scope of the present invention which is accordingly to be limited only by the following claims.

What is claimed is:

1. A roller bearing support assembly usable to support an axle trunnion of a roller in a rotary press, said roller bearing support assembly comprising:
- at least a first support lever;
- means for securing a first end of said support lever to the rotary press for pivotal movement;
- an axle trunnion receiving seat at a second end of said support lever, said seat being generally U-shaped and having an open mouth;
- a cross piece securable across said open mouth of said U-shaped seat;
- means on said cross piece for adjusting the impression pressure of a roller supported in said roller bearing support assembly against a cylinder in the rotary press;
- a resilient support means in a bottom portion of said axle trunnion receiving seat;
- an opening in said lever intermediate said first and second ends of said lever, said opening being positionable about a frame fixed stop;
- means to move said pivotal lever through a stroke for throwing-on or throwing-off a roller supported by said lever arm; and
- means in said opening to limit a distance of said stroke.

2. The roller bearing support assembly of claim 1 wherein said means to limit said stroke distance includes a threaded abutment screw.

3. The roller bearing support assembly of claim 1 wherein said means to move said lever includes a single acting cylinder.

4. The roller bearing support assembly of claim 1 wherein said means on said cross piece for adjusting said impression pressure includes an upper threaded screw surrounded by a cup spring packet.

5. The roller bearing support assembly of claim 2 wherein said threaded abutment screw is surrounded by a cup spring packet.

6. The roller bearing support assembly of claim 1 wherein said generally U-shaped seat has spaced lateral cheeks.

7. The roller bearing support assembly of claim 1 wherein said resilient support includes a conical borehole in said lever extending from said bottom portion of said seat to an opening of said lever.

8. The roller bearing support assembly of claim 1 wherein said means for securing said first end of said lever to the press includes a cylindrical body.

9. A roller bearing support assembly usable to support an axle trunnion of a forme roller in a rotary press, said roller bearing support assembly comprising:
- at least a first support lever;
- means for securing a first end of said support lever to the rotary press for pivotal movement;
- an axle trunnion receiving seat at a second end of said support lever, said seat being generally U-shaped with an open mouth and including spaced, generally parallel axle trunnion guiding surfaces;
- a forme roller rotatably supported in said roller bearing support assembly, said forme roller having an axle trunnion with an axis of rotation and being adjustably supported in said axle trunnion receiving seat for movement along an axis of adjustment generally parallel to said axle trunnion guiding surfaces;
- a driven roller supported in the rotary press and being engageable by said forme roller, said driven roller having a driven roller axis of rotation; said driven roller axis being displaced from said rotational axis of said means for securing said first end of said lever;
- a first plane extending through a rotational axis of said means for securing said first end of said lever for pivotal movement and said driven roller axis of rotation, said forme roller axis of rotation being located adjacent said first plane;
- a cylinder supported in the rotary press and being engageable by said forme roller at a point of contact; and
- a second plane extending tangent to said cylinder at said point of contact, said second plane being generally parallel to said axis of adjustment of said forme roller in said roller bearing support assembly.

10. The roller bearing support assembly of claim 9 wherein said means for securing said first end of said support lever to the rotary press includes a hexagon cup screw with a fitted shaft.

11. The roller bearing support assembly of claim 9 wherein said axle trunnion is adjustably supported in said seat by upper and lower adjusting screws and further wherein said forme roller axis of adjustment is defined by center line of said upper and lower adjusting screws.

12. The roller bearing support assembly of claim 9 wherein said support lever is generally arcuate.

13. The roller bearing support assembly of claim 9 further including a cross piece securable across an open mouth of said U-shaped seat and an adjustment screw carried by said cross piece and extending along said forme roller axis of adjustment.

14. The roller bearing support assembly of claim 9 further including a resilient support means in a bottom portion of said axle trunnion receiving seat, said resilient support means extending along said forme roller axis of adjustment.

15. The roller bearing support assembly of claim 9 further including means to move said pivotable support lever through a stroke for throwing-on or throwing-off said forme roller, and stop means engageable with said pivotable lever to limit said throw-on and throw-off movement.

16. The roller bearing support assembly of claim 15 wherein said means for moving said pivotable support lever includes a double acting cylinder.

17. The roller bearing support assembly of claim 15 wherein said stop means includes an opening in said support lever intermediate said first and second ends of said support lever and a frame fixed stop positional within said opening.

18. The roller bearing support assembly of claim 9 wherein said at least first support lever includes a curved portion intermediate its first and second ends, said curved portion being located adjacent said driven roller.

19. The roller bearing assembly of claim 9 further including a second roller bearing support assembly supporting a second forme roller for contact with said driven roller and said cylinder.

* * * * *